US011891763B2

(12) United States Patent
Doy et al.

(10) Patent No.: US 11,891,763 B2
(45) Date of Patent: Feb. 6, 2024

(54) MILLING SYSTEM AUTOMATED OBSTACLE MITIGATION

(71) Applicant: Caterpillar Paving Products Inc., Brooklyn Park, MN (US)

(72) Inventors: Nathaniel S. Doy, Maple Grove, MN (US); Heath Daryl Wilson, Ore City, TX (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 17/676,623

(22) Filed: Feb. 21, 2022

(65) Prior Publication Data

US 2023/0265621 A1 Aug. 24, 2023

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/0933; E01C 23/0946; E01C 23/0993; E01C 23/127
See application file for complete search history.

(56) References Cited

U.S. PATENT DOCUMENTS

| | | | | |
|---|---|---|---|---|
| 4,270,801 | A | 6/1981 | Swisher, Jr. et al. | |
| 5,607,205 | A * | 3/1997 | Burdick | E01C 23/088 404/84.2 |
| 6,152,648 | A * | 11/2000 | Gfroerer | E01C 23/088 404/93 |
| 8,944,517 | B2 | 2/2015 | Franzmann et al. | |
| 10,704,213 | B2 | 7/2020 | Gerhardy et al. | |
| 10,776,638 | B2 | 9/2020 | Engelmann | |
| 2013/0162003 | A1* | 6/2013 | Killion | E01C 23/088 299/1.5 |
| 2016/0265174 | A1* | 9/2016 | Engelmann | E01C 23/088 |
| 2016/0340842 | A1 | 11/2016 | Adams | |
| 2019/0024328 | A1* | 1/2019 | Stahl | E01C 23/01 |
| 2020/0193179 | A1* | 6/2020 | Engelmann | E01C 23/127 |

* cited by examiner

*Primary Examiner* — Abby J Flynn
*Assistant Examiner* — Michael A Goodwin
(74) *Attorney, Agent, or Firm* — Schwegman Lundberg & Woessner, P.A.

(57) ABSTRACT

A machine for roadwork can include a frame, a power source, and a milling rotor operatively connected to the power source and the frame. The machine can also include means for detecting obstacles around an exterior of the machine; and means for activating an obstacle-detection response. The obstacle-detection response can adjust at least one milling parameter, change at least one sensor that the machine uses to control at least one mil ling parameter, or override at least one system on the machine to prevent the machine from automatically adjusting any milling parameters.

18 Claims, 6 Drawing Sheets

MILLING SYSTEM AUTOMATED OBSTACLE MITIGATION

TECHNICAL FIELD

This disclosure relates to machinery used to work on roadways, and more particularly, to milling machinery used to work on roadways.

BACKGROUND

Asphalt-surfaced roadways are built to facilitate vehicular travel. Depending upon usage density, base conditions, temperature variation, moisture variation, and/or physical age, the surface of the roadways eventually become misshapen, non-planar, unable to support wheel loads, or otherwise unsuitable for vehicular traffic. In order to rehabilitate the roadways for continued vehicular use, spent asphalt is removed in preparation for resurfacing.

Cold planers, sometimes also referred to as road mills or scarifiers, are machines that typically include a frame propelled by tracked drive units. The frame supports an engine, an operator's station, and a milling rotor. The milling rotor, fitted with cutting tools, is rotated through a suitable interface by the engine to break up the surface of the roadway. The broken-up roadway material is deposited by the milling rotor onto a conveyor, or series of conveyors, that transport the material away from the machine and to a nearby haul vehicle for transportation away from the job site.

Control modules are provided in machines such as cold planers to operate the milling rotor and to control certain mechanisms associated with the machine. However, it is common for the operation of cold planers to require at least one operator on the road level to spot potential hazards and to adjust the milling parameters of the cold planer to navigate past those potential hazards.

U.S. Pat. No. 10,776,638 to Engelmann et al., assigned to Caterpillar Paving Products, and issued on Sep. 15, 2020 discloses an example cold planer system includes a machine frame, a milling rotor disposed in a milling chamber, a first sensor, a second sensor and a control module. The control module comprises a processor and a controller. The processor is configured to receive a first signal indicative of a direction of motion of the machine, and a second signal indicative of whether an object is present in an object detection zone. The processor processes the first signal and the second signal to generate a control signal. The controller is configured to receive the control signal from the processor and to initiate a rotor collision avoidance mode if an object is present in an object detection zone.

SUMMARY OF THE INVENTION

In one example, a machine for roadwork can include a frame, a power source, and a milling rotor. The milling rotor can be operatively connected to the power source and the frame. The machine can also include at least one obstacle-detection sensor configured to detect obstacles around an exterior the machine. The machine can also include a controller configured to, in response to a signal received by the at least one obstacle-detection sensor, activate an obstacle-detection response. The obstacle-detection response can adjust at least one milling parameter, change at least one sensor that the machine uses to control at least one milling parameter, or override at least one system on the machine to prevent the machine from automatically adjusting any milling parameters.

In another example, a method of controlling a machine, the machine can include a frame, a power source, a milling rotor operatively connected to the power source and the frame, at least one obstacle-detection sensor, and a controller. The method can include milling with the machine, by inputting into a human-machine interface at least one mil ling parameter and detecting with the at least one obstacle-detection sensor, any possible obstacles around the exterior of the machine. The method can also include analyzing, via the controller, signal from the at least one obstacle-detection sensor to predict when an obstacle around an exterior of the machine could cause issues with the machine or effect the milling of the machine, and activating, via the controller, an obstacle-detection response The obstacle-detection response can adjust at least one milling parameter, change at least one sensor that the machine uses to control at least one milling parameter, or override at least one system on the machine to prevent the machine from automatically adjusting any milling parameters.

In another example, a machine for roadwork can include a frame, a power source; and a milling rotor operatively connected to the power source and the frame. The machine can also include means for detecting obstacles around an exterior of the machine; and means for activating an obstacle-detection response. The obstacle-detection response can adjust at least one milling parameter, change at least one sensor that the machine uses to control at least one milling parameter, or override at least one system on the machine to prevent the machine from automatically adjusting any milling parameters.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

During the operation of a cold planer, or a roadway milling machine, it is typical for a first operator to be operating the machine from an operator seat, while at least one other operator assists from the ground level. The ground-level operator watches for obstacles around an exterior of the machine. If the ground-level operator observes an obstacle around an exterior of the machine they will interact with the machine to manually override the operations and avoid the obstacle. For example, the ground-level operator may physically reconfigure components of the machine, like raising the side plates, raising the milling depth, or adjust any other milling parameter. An automated operation that allows just a single operator to operate the machine can include an obstacle-detection system configured to generate an obstacle-detection response when an object is detected around an exterior of the machine that will interfere with the operation of the machine.

Figure 1:
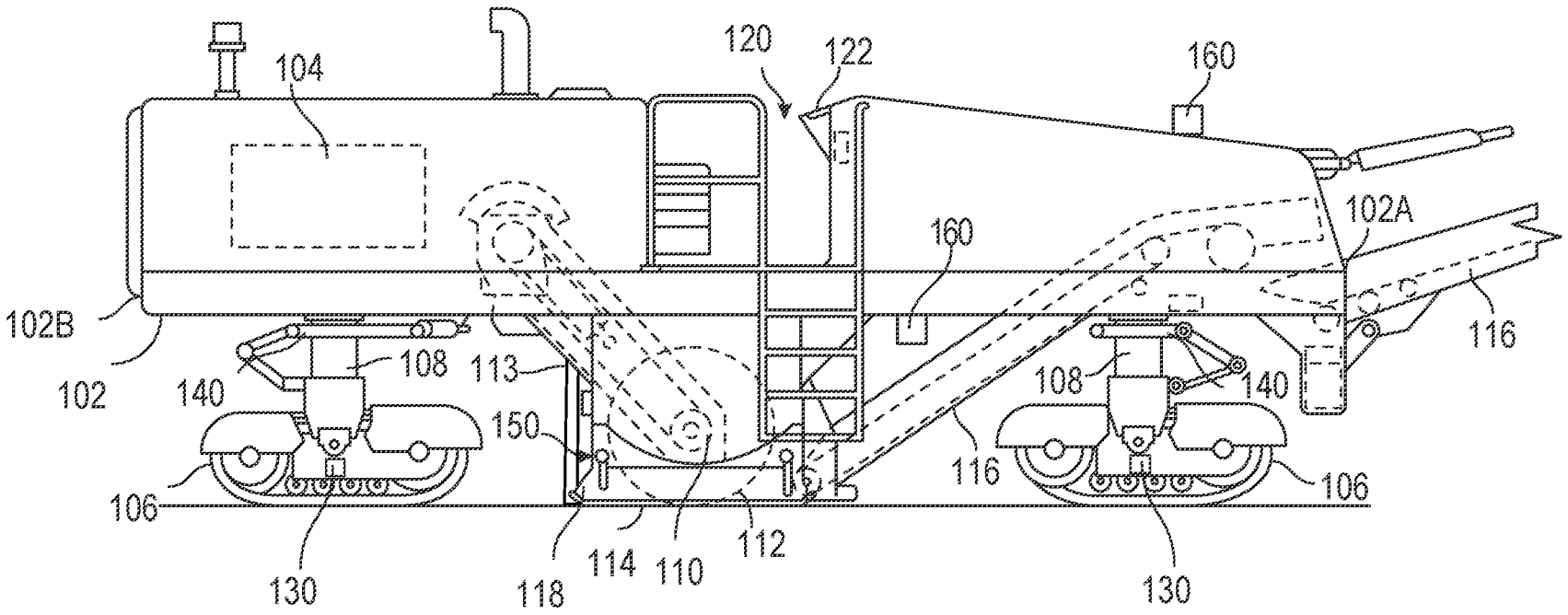
FIG. 1 illustrates a schematic side view of an example of a machine.

FIG. 1 illustrates a schematic side view of an example of a machine 100. The machine 100 can include a frame 102, a power source 104, a plurality of ground engaging units (hereinafter referred to as "ground-engaging units 106"), and a plurality of vertically movable legs (hereinafter referred to as "vertically-movable legs 108"). The power source 104 can be connected to the frame 102. The ground-engaging units 106 can be connected to the frame 102 by the vertically-movable legs 108. In the example of FIG. 1, the machine 100 can be a cold planer. In another example, the machine 100 can be any other machine used for roadwork.

The frame 102 can longitudinally extend between a first end 102A and a second end 102B. The power source 104 can be provided in any number of different forms including, but not limited to, internal combustion engines, electric motors, hybrid engines, or any power source used to power construction equipment. Power from the power source 104 can be transmitted to various components and systems of the machine 100, such as the ground-engaging units 106 or a milling assembly 110.

The frame 102 can be supported by the ground-engaging units 106 via the vertically-movable legs 108. The ground-engaging units 106 can be any kind of ground-engaging device that allows the machine 100 to move over a ground surface such as a paved road or a ground already processed by the machine 100. For example, as shown in FIG. 1, the ground-engaging units 106 can be configured as track assemblies or crawlers. In other examples, the ground-engaging units 106 can be configured as wheels, such as inflatable or hard tires, or any other ground-engaging device used for navigating construction vehicles.

The ground-engaging units 106 can be configured to move the machine 100 in forward and backward directions along the ground surface. The vertically-movable legs 108 can be configured to raise and lower the frame 102 relative to the ground-engaging units 106 and the ground. One or more of the vertically-movable legs 108 can be configured to rotate about their central axis to provide steering for the machine 100.

The machine 100 can include multiple of the ground-engaging units 106, for example, four: a front left ground-engaging unit, a front right ground-engaging unit, a rear left ground-engaging unit, and a rear right ground-engaging unit, each of which can be connected to vertically-movable legs 108, respectively. As shown ire FIG. 1, the machine 100 can include four of the ground-engaging units 106 and four of the vertically-movable legs 108 where two of the ground-engaging units 106 and two of the vertically-movable legs 108 shown in are further into the plane of FIG. 1. However, in other examples, the machine 100 can utilize fewer than four of the ground-engaging units 106, such as three. Although, the present disclosure is not limited to any particular number of propulsion devices or lifting columns.

The vertically-movable legs 108 can be provided to raise and lower the frame 102 to, for example, control a cutting depth of a milling rotor 112 and to accommodate the machine 100 engaging obstacles on the ground.

The machine 100 can include the milling assembly 110 connected to the frame 102. The milling assembly 110 can include a milling rotor 112. The milling rotor 112 can be operatively connected to the power source 104. The frame 102 can include a plurality of cutting tools (not shown), such as chisels, disposed thereon. The milling rotor 112 can be rotated about its center axis. As the milling rotor 112 rotates, the cutting tools can engage a work surface 114. The work surface 114 can be asphalt, concrete, or any other material used to make existing roadways, bridges, or parking lots. Moreover, as the milling rotor 112 engages the work surface 114, the cutting tools can remove layers of materials forming the work surface 114, such as hardened dirt, rock, or pavement. The spinning action of the milling rotor 112 and the cutting tools can transfer the material of the work surface 114 onto a conveyor system 116. The conveyor system 116 can remove the material from near the milling rotor 112 and carries the material away from the milling rotor 112 to be deposited in a receptacle. For example, the receptacle can be a box of a dump truck.

The machine 100 can also include a pair of side plates (hereinafter referred to as "side plates 118"). The side plates 118 can act as lateral covers to the milling assembly 110 and the milling rotor 112. Thus, the milling rotor 112 can be located between the side plates 118.

Figure 2:
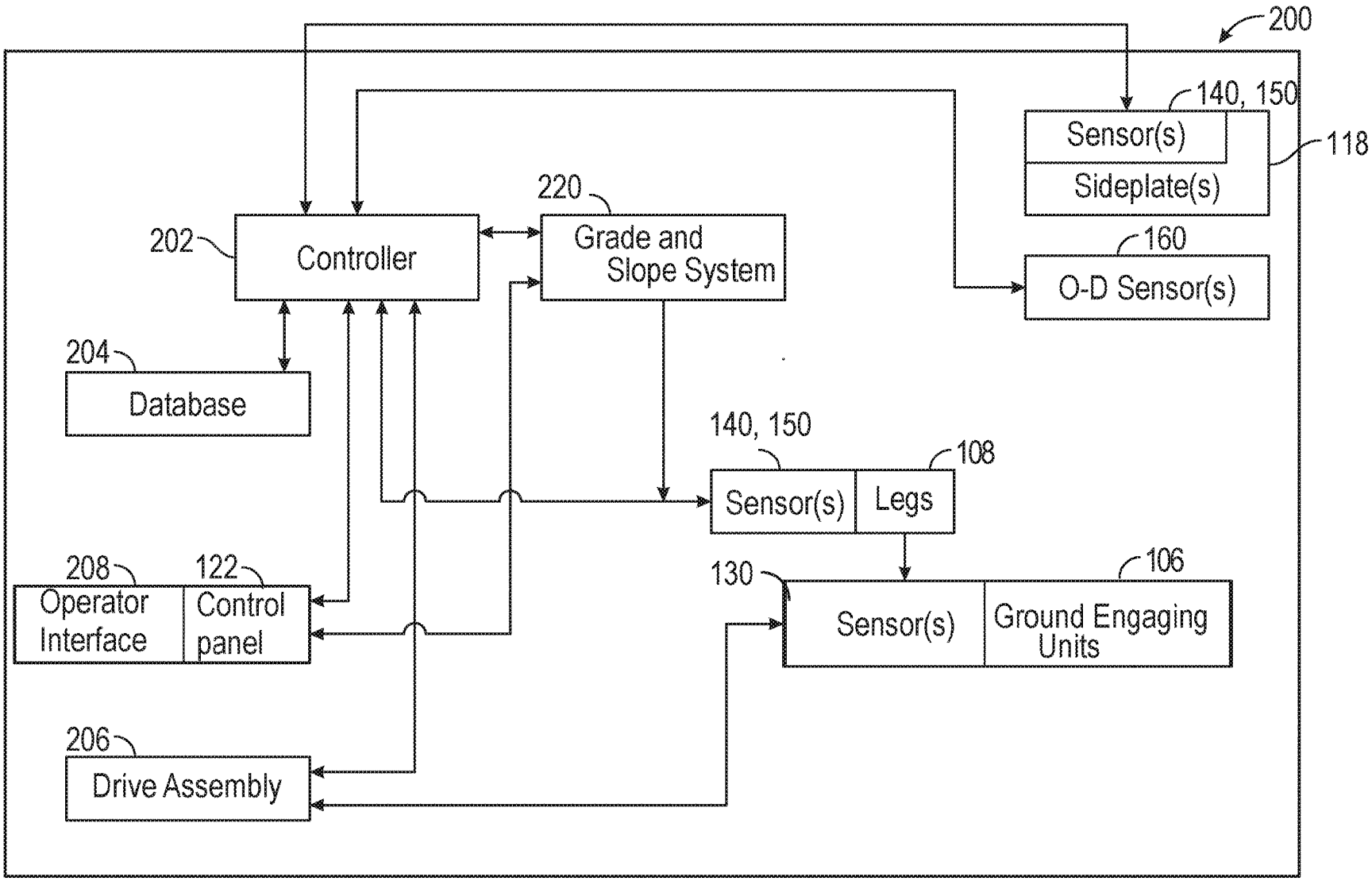
FIG. 2 illustrates a schematic diagram of a control system for a machine.

The machine 100 can include sensors that communicate to a control system 200 (FIG. 2). For example, the ground-engaging units 106 of the machine 100 can include a sensor 130. The sensor 130 on the ground-engaging units 106 can be an optical or magnetic sensor (e.g., a proximity sensor), or any other sensor used to measure rotational speed of the ground-engaging units 106.

In another example, the machine 100 can include a vertical motion sensor 140 to detect vertical movement of the machine 100. The vertical motion sensor 140 can be mounted on the frame 102, either of the side plates 118, or the inboard ski 113. The vertical motion sensor 140 can be a position sensing hydraulic cylinder, linear variable differential transformer, a piezoelectric transducer, a laser doppler vibrometer, an eddy-current sensor, or any other sensor used to detect vertical motion.

In another example, at least one of the side plates 118 can include a sensor 150 that is configured to measure the cutting depth of the machine 100. The sensor 150 can be position-sensing hydraulic cylinders, contact sensors, or any other sensor to determine cutting depth.

In another example, the milling assembly 110 can include an inboard ski 113. The inboard ski 113 can be connected to the milling rotor 112 and can optionally include the sensor 150. The sensor 150 can be a slope sensor, a contact sensor, position-sensing hydraulic cylinders, or any other sensor that can be used to detect the cutting depth.

In another example, the machine 100 can include at least one obstacle-detection sensor 160 configured to detect obstacles around an exterior of the machine 100. As discussed above, the ground-engaging units 106 of the machine 100 can be configured to move in a forward or a backward direction, and ground-engaging units 106 and vertically-movable legs 108 can be configured to steer the machine 100. Thus, the at least one obstacle-detection sensor 160 can be configured to detect objects around an exterior of the machine 100 to detect objects that may come into contact with the machine 100 or detect objects that could affect the travel or work-product of the machine 100. Because the obstacle-detection sensor 160 is configured to detect obstacles around an exterior of the machine 100, the obstacle-detection sensor 160 is not solely looking for objects that are within a milling window or objects that will come into contact with the milling rotor 112.

The at least one obstacle-detection sensor 160 can be a camera, radar, or a combination thereof including any other perception sensors. The at least one obstacle-detection sensor 160 can be attached to the frame 102 of the machine 100. The above-mentioned sensors are solely examples of sensors that the machine 100 can include and is not in any way an exhaustive list of sensors that the machine 100 can include.

The machine 100 can further include operator station or a platform 120 including a control panel or a human-machine interface (hereinafter referred to as "control panel 122") for inputting commands to the control system 200 for controlling the machine 100, and for outputting information related to an operation of the machine 100. As such, an operator of the machine 100 can perform control and monitoring functions of the machine 100 from the platform 120, such as by observing various data output by various sensors located on the machine 100. Furthermore, the control panel 122 can include controls for operating the ground-engaging units 106 and the vertically-movable legs 108.

The machine 100, as well as other exemplary road construction machines such as rotary mixers, can include further components not shown in the drawings, which are not described in further detail herein. For example, the machine 100 can further include a fuel tank, a cooling system, a milling fluid spray system, various kinds of circuitry and computer-related hardware, or any combination thereof.

FIG. 2 illustrates a schematic diagram of the control system 200 for the machine 100. The machine 100 can be controlled by one or more embedded or integrated controllers (hereinafter referred to as "controller 202"). The controller 202 can include one or more processors, microprocessors, microcontrollers, electronic control modules (ECMs), electronic control units (ECUs), programmable logic controller (PLC), or any other suitable means for electronically controlling functionality of the machine 100.

The Controller 202 can be configured to operate according to a predetermined algorithm or set of instructions for controlling the machine 100 based on various operating conditions of the machine 100, such as can be determined from output of any of the various sensors. Such an algorithm or set of instructions can be stored in a database 204, can be read into an on-board memory of the controller 202, or preprogrammed onto a storage medium or memory accessible by the controller 202, for example, in the form of a floppy disk, hard drive, optical medium, random access memory (RAM), read-only memory (ROM), or any other suitable computer-readable storage medium commonly used in the art (each referred to as a "database"), which can be in the form of a physical, non-transitory storage medium.

The controller 202 can be in electrical communication or connected to a drive assembly 206, or the like, and various other components, systems or sub-systems of the machine 100. The drive assembly 206 can comprise an engine, a hydraulic motor, a hydraulic system including various pumps, reservoirs, actuators, or combinations thereof, among other elements (such as the power source 104 of FIG. 1). By way of such connection, the controller 202 can receive data pertaining to the current operating parameters of the machine 100 from sensors, such as, the sensor 130, the vertical motion sensor 140, the sensor 150, the at least one obstacle-detection sensor 160, and the like. In response to such input, the controller 202 can perform various determinations and transmit output signals corresponding to the results of such determinations or corresponding to actions that need to be performed, such as for changing at least one milling parameter. The at least one milling parameter can be cutting depth, cutting angle, cutting speed, machine speed, machine direction, or a combination thereof.

The controller 202, including a human-machine interface or an operator interface (hereinafter referred to as "operator interface 208"), can include various output devices, such as screens, video displays, monitors and the like that can be used to display information, warnings, data, such as text, numbers, graphics, icons, and the like, regarding the status of the machine 100. The controller 202, including the operator interface 208, can additionally include a plurality of input interfaces for receiving information and command signals from various switches and sensors associated with the machine 100 and a plurality of output interfaces for sending control signals to various actuators associated with the machine 100. Suitably programmed, the controller 202 can serve many additional similar or wholly disparate functions as is well-known in the art.

With regard to input, the controller 202 can receive signals or data from the operator interface 208 (such as at the control panel 122 of FIG. 1), the sensor 130, the vertical motion sensor 140, the sensor 150, the at least one obstacle-detection sensor 160, and the like. As can be seen in the example illustrated in FIG. 2, the controller 202 can receive signals from the operator interface 208. Such signals received by the controller 202 from the operator interface 208 can include, but are not limited to, an all-leg raise signal and an all-leg lower signal for the vertically-movable legs 108. In some embodiments, the vertically-movable legs 108 nearest the first end 102A of the frame 102 can be controlled individually directly, while the vertically-movable legs 108 nearest the second end 102B of the frame 102 are controlled together indirectly based on movements of the vertically-movable legs 108 nearest the first end 102A.

The controller 202 can also receive position or length data from each of the vertical motion sensor 140. As noted before, such data can include, but is not limited to, information as to the lengths of the vertically-movable legs 108 or the amount of extension or retraction of the vertically-movable legs 108. Such information can be used to determine an orientation of the frame 102 relative to the sensor 130 of the ground-engaging units 106.

The controller 202 can also receive data from one or more of the sensor 150 on either of the side plates 118 (FIG. 1) or on the inboard ski 113 (FIG. 1). Such data can include, but is not limited to, information related to the vertical position of the side plates 118, the angle or slope of the side plates 118, and/or whether the side plates 118 are in contact with the work surface 114. Such data can also be used to determine a difference in the height of the work surface 114 on either side of the milling rotor 112.

The controller 202 can also receive data from other controllers, for example, a grade and slope system 220 for the machine 100, the operator interface 208, and the like. In examples, another controller can provide information to the controller 202 regarding the operational status of the machine 100.

In other examples, such information can be provided by the grade and slope system 220, a hydraulic system controller or the like, to the controller 202. The operation status received can include whether the machine 100 is in non-milling operational status or milling operational status (e.g., the milling rotor 112 is not spinning or the milling rotor 112 is spinning).

In examples, the grade and slope system 220 can receive and process data from the operator interface 208 related to the operator's desired depth of the cut, the slope of the cut, and the like. The grade and slope system 220 can receive a signal from one or more of the sensor 150. In examples, as discussed above, the sensor 150 can be connected to either, or both, of the side plates 118, connected to the inboard ski 113, or to any other component of the machine 100. The grade and slope system 220 can also receive milling parameters, for example, machine speed, machine direction, machine grade, machine slope, milling speed, milling depth, milling angle, or any other parameter used in milling operations.

In examples, the grade and slope system 220 can use the received milling parameters, and the signals received from various other sensors (e.g., the sensor 130, the vertical motion sensor 140, the sensor 150, or the like), to maintain a grade and slope received from the operator interface 208. The grade and slope system 220 can maintain the grade and slope received from the operator interface 208 gives the operator of the machine 100 one less milling parameter to control while operating the machine 100. However, even with the grade and slope system 220, ground operators can be necessary.

An automated operation that allows just a single operator to operate the machine can include an obstacle-detection system configured to generate an obstacle-detection response when an object is detected around an exterior of the machine that will interfere with the operation of the machine will be discussed below with references to FIGS. 3-6.

Figure 3:
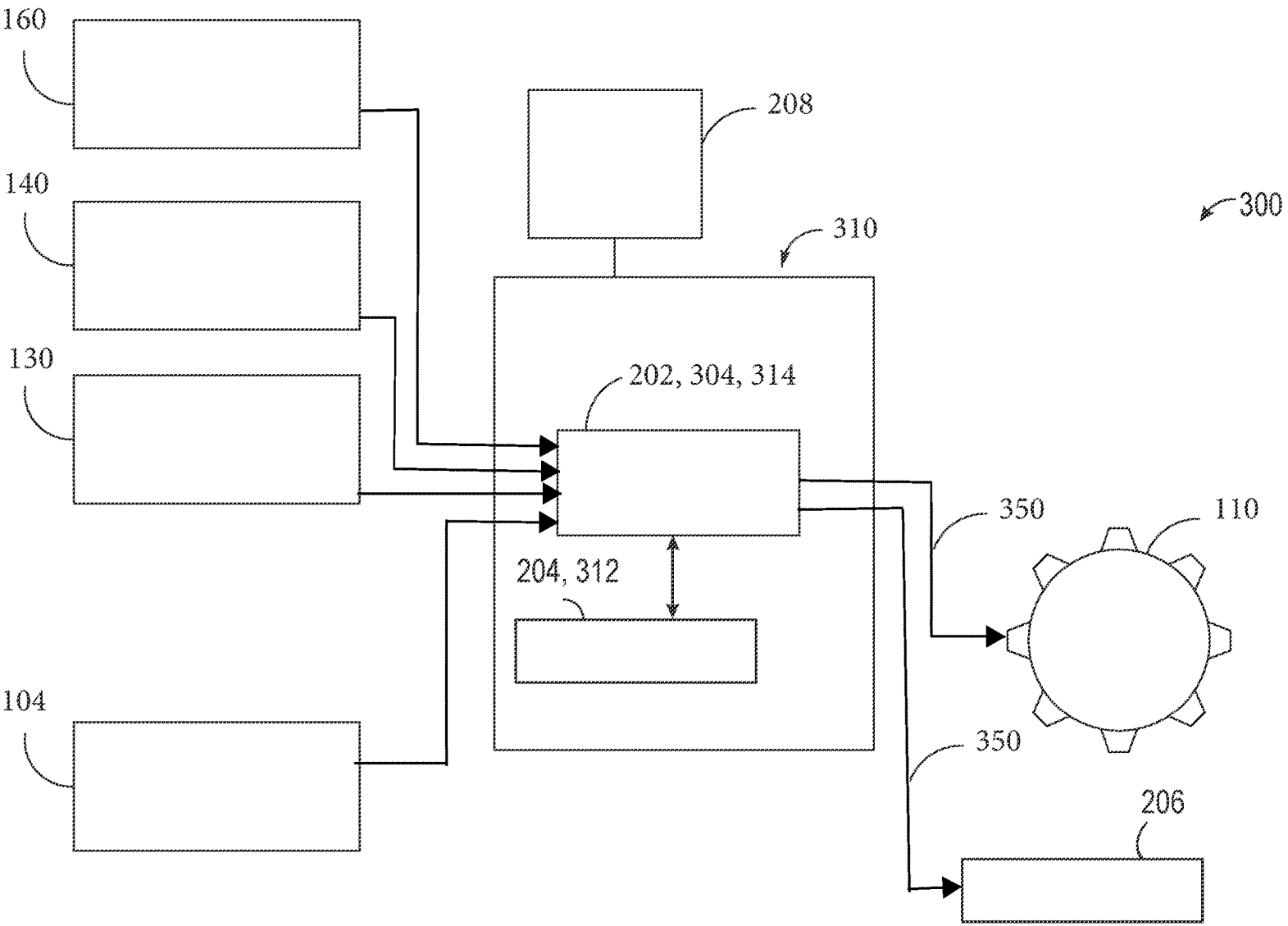
FIG. 3 illustrates a schematic diagram showing an example of an obstacle-detection system for a machine.

FIG. 3 illustrates a schematic diagram showing an example of an obstacle detection and response system 300 for the machine 100. The machine 100 can include the obstacle detection and response system 300 to detect obstacles around an exterior and change at least one milling parameter in response to the detected obstacle in front of the machine 100. In examples, as shown in FIG. 3, the obstacle detection and response system 300 can be powered by the power source 104, or the obstacle detection and response system 300 can have a different source of power. The obstacle detection and response system 300 can send and receive signals to the operator interface 208 or the obstacle detection and response system 300 can have its own operator interface located near the control panel 122 (FIG. 1).

The obstacle detection and response system 300 can include a control module 310. The control module 310 can include a database 312 and a controller (which can be interchangeably referenced herein as controller 304 or controller 314). Like the controller 202, the controller 314 can be configured to operate according to a predetermined algorithm or set of instructions for controlling the machine 100 based on various operating conditions of the machine 100, such as can be determined from the output of any of the various sensors. Such an algorithm or set of instructions can be stored in the database 312, can be read into an on-board memory of the controller 314, or preprogrammed onto a storage medium or memory accessible by the controller 304, for example, in the form of a floppy disk, hard drive, optical medium, random access memory (RAM), read-only memory (ROM), or any other suitable computer-readable storage medium commonly used in the art (each referred to as a "database"), which can be in the form of a physical, non-transitory storage medium.

As shown in FIG. 3, the control module 310 can have the database 312 and the controller 314. In other examples, the obstacle detection and response system 300 and the control module 310, can utilize the controller 202 and the database 204 to detect objects around an exterior of the machine 100.

In examples shown in FIG. 3, the control module 310 and the controller 314 can receive signals from the sensor 130 (FIG. 1), the vertical motion sensor 140 (FIG. 1), and at least one of the at least one obstacle-detection sensor 160 (FIG. 1). The controller 314 can receive a signal from the sensor 130 to calculate a machine speed that the machine 100 is traveling. The controller 314 can receive a signal from the vertical motion sensor 140 to calculate vertical motion in the ground-engaging units 106 with relation to the frame 102 of the machine 100. The controller 314 can receive a signal from the at least one obstacle-detection sensor 160 to detect objects around an exterior of the machine 100.

In examples, the control module 310 can process all of the signals received from sensors (the sensor 130, the vertical motion sensor 140, at least one of the at least one obstacle-detection sensor 160) and can use those signals to determine if an object will interfere with the operation of the machine 100. If the control module 310 determines that an object will interact with the machine 100, the control module 310 can send a signal to the milling assembly 110 or the drive assembly 206 to hold or change at least one of the milling parameters. The control module 310 can also send a signal to the operator interface 208 (FIG. 2), to alert the operator of the obstacle and the automated change to at least one of the milling parameters.

As discussed above, the milling parameters can be, for example, machine speed, machine direction, machine grade, machine slope, milling speed, milling depth, milling angle, or any other parameter used in milling operations. In examples, in response to pre-determined conditions, the control module 310 of the obstacle detection and response system 300 can output an obstacle-detection response 350. The obstacle-detection response 350 can override at least one parameter of the machine 100. For example, for some of the obstacle-detection response 350, the control module 310 can send a signal to the drive assembly 206 to adjust machine speed, machine direction, machine grade, machine slope, or any other parameter controlled by the drive assembly 206 of the machine 100. Moreover, for other examples, for some of the obstacle-detection response 350, the control module 310 can send a signal to the milling assembly 110 to adjust milling speed, milling depth, milling angle, or any other parameter controlled by the milling assembly 110 of the machine 100. In yet another example, for some of the obstacle-detection response 350, the control module 310 can send a signal to the drive assembly 206 and the milling assembly 110.

Figure 4:
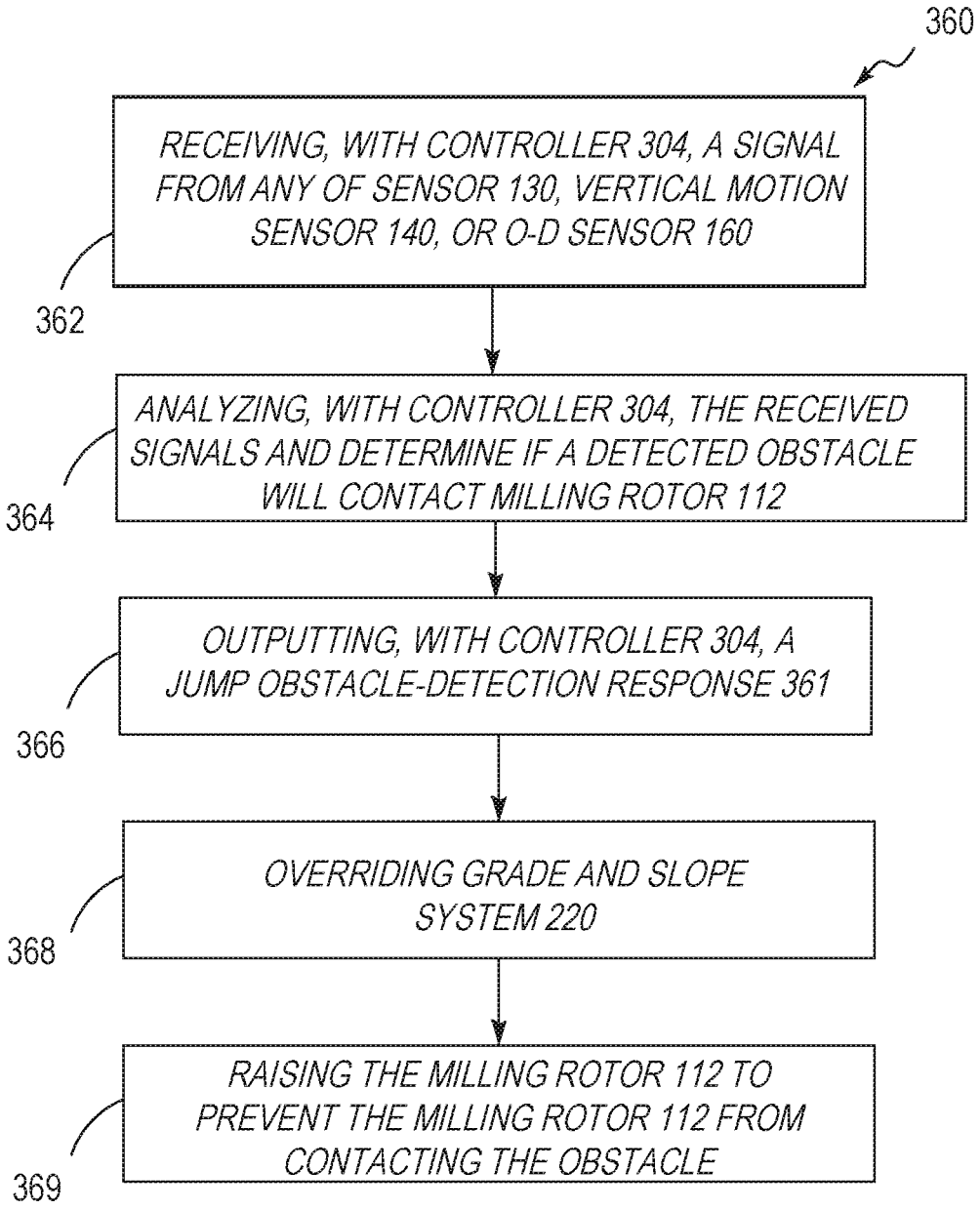
FIG. 4 illustrates a flowchart of an example of an operation of a machine.

FIG. 4 illustrates a flowchart of an example of one of the obstacle-detection response 350 including a jump sequence 360 of the machine 100. In examples, the obstacle-detection response 350 can include the jump sequence 360. The jump sequence 360 can result in a jump obstacle-detection response 361.

At step 362, the controller 304 can receive a signal from any of the sensor 130, the vertical motion sensor 140, or at least one of the at least one obstacle-detection sensor 160. At step 364, the controller 304 can analyze the received signals from step 362, and using programs installed on the database 204 (FIG. 2) determine if a detected object that is around an exterior of the machine 100 will contact the milling rotor 112 without intervention. At step 366, the controller 304 can output the jump obstacle-detection response 361. At step 368, the jump obstacle-detection response 361 can override the grade and slope system 220, which prevents the grade and slope system 220 from automatically adjusting any of the milling parameters. At step 369, the controller 304 can send a signal to raise the milling rotor 112 to prevent the milling rotor 112 from contacting the obstacle around an exterior of the machine 100.

Figure 5:
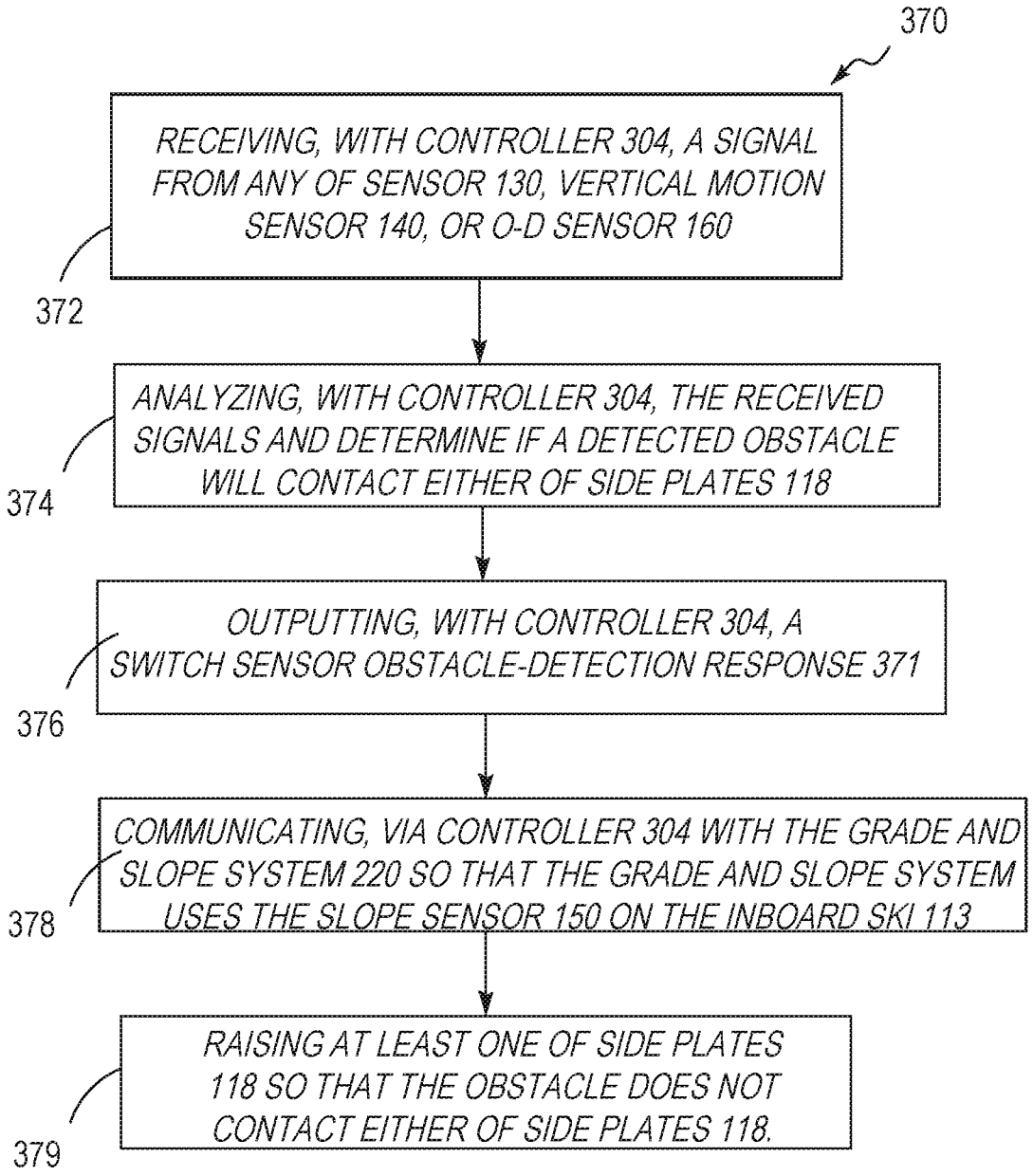
FIG. 5 illustrates a flowchart of an example of an operation of a machine.

FIG. 5 illustrates a flowchart of an example of the obstacle-detection response 350 including a sensor switch sequence 370 of the machine 100. In examples, the obstacle-detection response 350 can include the sensor switch sequence 370. The sensor switch sequence 370 can result in a sensor switch obstacle-detection response 371. At step 372, the controller 304 can receive a signal from any of the sensor 130, the vertical motion sensor 140, or at least one of the at least one obstacle-detection sensor 160. At step 374, the controller 304 can analyze the received signals from step 372, and using programs installed on the database 204 determine if a detected object around an exterior of the machine 100 will contact either of the side plates 118 (FIG. 1) without intervention. At step 376, the controller 304 can output the sensor switch obstacle-detection response 371. At step 378, the sensor switch obstacle-detection response 371 can communicate with the grade and slope system 220 to have the grade and slope system 220 use the sensor 150 on the inboard ski 113. At step 379, the controller 304 can send a signal to raise at least one of the side plates 118 to prevent the side plates 118 from contacting the obstacle around an exterior of the machine 100.

Figure 6:
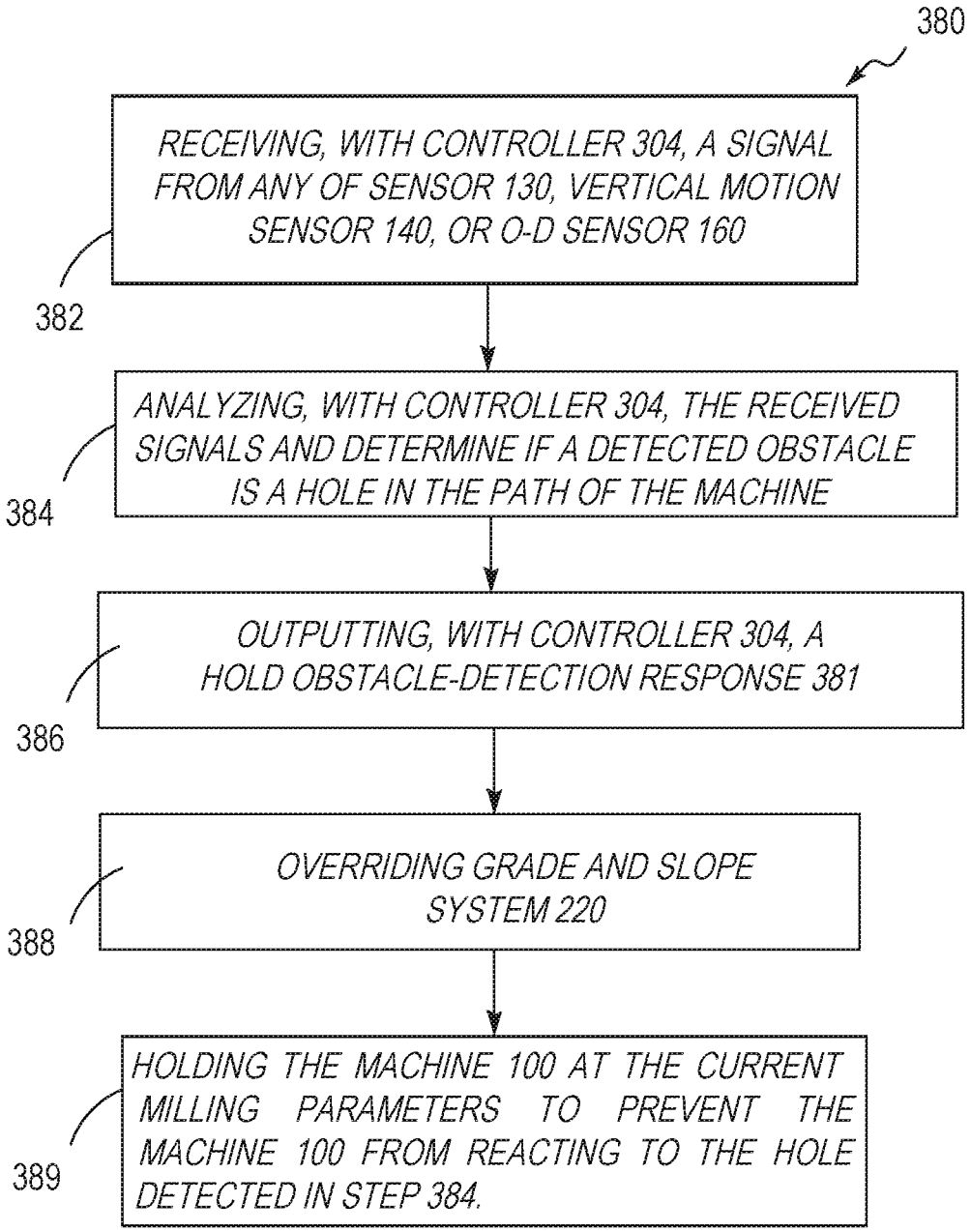
FIG. 6 illustrates a flow chart of an example of an operation of a machine.

FIG. 6 illustrates a flowchart of an example of one of the obstacle-detection response 350 including a hold sequence 380 of the machine 100. In examples, the obstacle-detection response 350 can include the hold sequence 380. The hold sequence 380 can result in a hold obstacle-detection response 381.

At step 382, the controller 304 can receive a signal from any of the sensor 130, the vertical motion sensor 140, or at least one of the at least one obstacle-detection sensor 160. At step 384, the controller 304 can analyze the received signals from step 382, and using programs installed on the database 204 (FIG. 2) to determine if a detected object is a dip or a hole around an exterior of the machine 100. At step 386, the controller 304 can output the hold obstacle-detection response 381. At step 388, the hold obstacle-detection response 381 can override the grade and slope system 220, which prevents the grade and slope system 220 from automatically adjusting any of the milling parameters. At step 389, the controller 304 can send a signal to hold the milling rotor 112 at the current parameters that the milling rotor 112 is operating.

As shown in examples of FIGS. 4-6, the machine 100 can include the jump obstacle-detection response 361, the sensor switch obstacle-detection response 371, and the hold obstacle-detection response 381. In another example, the obstacle-detection response 350 can be any obstacle detection response that alters any of the milling parameters. For example, the obstacle-detection response 350 can be a response that increases or decreases the speed of the machine 100, stops the machine 100, stops the milling rotor 112, increases or decreases the rotational speed of milling rotor 112, or raises or lowers the frame 102 with the vertically-movable legs 108, or any combination thereof.

INDUSTRIAL APPLICABILITY

In an operating example of a machine according to this disclosure, the machine can be moving toward an obstacle that could cause damage to either the machine or the roadway that the machine is working on without intervention. An operator can control the machine with the help of one or more systems that automate components of the operation of the machine.

In an example, the machine can be equipped with a grade and slope system. The grade and slope system can automatically maintain a grade and slope selected by the operator.

In an example, the machine can be equipped with an obstacle detection and response system. The obstacle detection response system can automatically respond to obstacles that are detected around an exterior of the machine and can signal the operator with a signal on a control panel.

In an example, the obstacle detection response system can detect an obstacle around the exterior of the machine that could collide with a milling rotor of the machine, the obstacle detection response system can output a jump obstacle response signal. The jump obstacle response signal can raise the milling rotor so that the milling rotor does not contact the obstacle as the machine traverses over the obstacle.

In another example, the obstacle detection response system can detect an obstacle around the exterior of the machine that could collide with either of a pair of side plates, the obstacle detection response system can output a switch sensor obstacle response signal. The switch sensor obstacle response signal can send a message to a grade and slope system to switch the slope sensor that the grade and slope system uses from the slope sensor installed on at least one of the side plates, to the slope sensor installed on an inboard ski connected to the milling rotor. The switch sensor obstacle response can raise either of the side plates so that neither of the side plates contacts the obstacle around the exterior of the machine as the machine travels past the obstacle.

In another example, the obstacle detection response system can detect an obstacle around an exterior of the machine that is a dip or a hole, the obstacle detection response system can output a hold obstacle response signal. The hold obstacle response system can override the controllers of the grade and slope system and hold the milling rotor at the current milling parameters so that the machine will not automatically adjust for the dip or the hole, causing damage to the roadway.

In examples including the grade and slope system and the obstacle detection and response system, the machine can be operated with a single operator because the obstacle detection and response system automatically adjusts the machine if an obstacle that will negatively affect the machine or the road is detected around an exterior of the machine.

The above detailed description is intended to be illustrative, and not restrictive. The scope of the disclosure should, therefore, be determined with references to the appended claims, along with the full scope of equivalents to which such claims are entitled.

What is claimed is:

1. A machine for roadwork, the machine comprising:

a frame;

a power source;

a milling rotor operatively connected to the power source and the frame;

a pair of side plates, the milling rotor is located between the pair of side plates, and at least one of the side plates includes a sensor configured to measure cutting depth of the machine;

an inboard ski connected to the milling rotor, the inboard ski including at least one sensor configured to detect the cutting depth of the machine;

a grade and slope system that can be turned on by an operator of the machine, the grade and slope system includes a slope controller that automatically adjusts at least one milling parameter to maintain a grade and a slope entered by the operator;

at least one obstacle-detection sensor configured to detect obstacles around an exterior of the machine; and a controller configured to, in response to a signal received from the at least one obstacle-detection sensor, the controller determines that an obstacle will contact either of the side plates and activates an obstacle-detection response, the obstacle-detection response:

raises one or both of the side plates above the milling rotor; and directs the grade and slope system to use the at least one sensor on the inboard ski to measure the grade or slope of the machine.

2. The machine of claim 1, wherein the at least one obstacle-detection sensor is attached to the frame of the machine.

3. The machine of claim 1, further comprising:

a plurality of ground engaging units, at least one of the plurality of ground engaging units includes a sensor to detect rotational movement of at least one of the plurality of ground engaging units; and a plurality of vertically movable legs, each leg connecting one of the plurality of ground engaging units to the frame, wherein the controller calculates a machine speed based on a signal received from the sensor on at least one of the plurality of ground engaging units.

4. The machine of claim 3, further comprising:

at least one vertical motion sensor attached to the machine, the at least one vertical motion sensor generates a signal indicative of vertical motion of the machine relative to a worksurface, wherein the controller of the grade and slope system, in response to the signal received from the at least one vertical motion sensor, further adjusts the at least one milling parameter to maintain the grade and slope entered by the operator.

5. The machine of claim 4, further comprising:

at least one human-machine interface located near a machine operator seat such that the operator of the machine can engage with the at least one human-machine interface while sitting in the machine operator seat, wherein the controller sends a signal to the at least one human-machine interface to warn the operator of the obstacles around an exterior of the machine and indicates the obstacle-detection response.

6. The machine of claim 5, wherein in response to receiving signals from the at least one obstacle-detection sensor, the sensor on at least one of the plurality of ground engaging units, or a vertical motion sensor on at least one of the plurality of vertically movable legs, the controller determines that an obstacle will contact the milling rotor.

7. The machine of claim 6, wherein in response to determining that the obstacle will contact the milling rotor, the obstacle-detection response is a jump obstacle-detection response that overrides the grade and slope system and raises the milling rotor to avoid contact with the obstacle.

8. The machine of claim 6, the wherein:

in response to receiving signals from the sensor on at least one of the plurality of ground engaging units, or the at least one vertical motion sensor, the controller determines that an obstacle will contact either of the side plates, and wherein the controller raises one or both of the side plates above the milling rotor, and directs the grade and slope system to use the at least one sensor on the inboard ski to measure the grade or slope of the machine.

9. The machine of claim 6, wherein:

in response to receiving signals from the at least one obstacle-detection sensor, the sensor on at least one of the plurality of ground engaging units, or the at least one vertical motion sensor, the controller determines that there is a dip around an exterior of the machine, and in response to the dip around an exterior of the machine the obstacle-detection response is a hold obstacle-detection response, and wherein the hold obstacle-detection response overrides the grade and slope system and holds all of the milling parameters at their present position until the machine passes the dip.

10. A method of controlling a machine, the machine comprising a frame, a power source, a milling rotor operatively connected to the power source and the frame, at least one obstacle-detection sensor, and a controller, the method comprising:

milling with the machine, by inputting into a human-machine interface at least one milling parameter;

maintaining the at least one milling parameter with a grade and slope system, the grade and slope system automatically adjusts the at least one milling parameter to maintain a grade and a slope entered by an operator;

measuring a grade or slope of the machine, via a slope sensor installed on at least one of a pair of side plates, wherein the milling rotor is located between the pair of side plates;

detecting with the at least one obstacle-detection sensor, any possible obstacles around an exterior of the machine;

determining, via the controller, that an obstacle will contact either of the side plates based at least on a signal from the at least one obstacle detection sensor;

outputting, via the controller, in response to an obstacle that will contact either of the pair of side plates, a change sensor obstacle-detection response;

communicating with the grade and slope system, via the controller, to start receiving signals from a slope sensor installed on an inboard ski connected to the milling rotor; and raising at least one of the pair of side plates with an actuator in response to the change sensor obstacle-detection response from the controller to prevent an obstacle from contacting either of the pair of side plates.

11. The method of claim 10, further comprising:

detecting a rotational movement of at least one of a plurality of ground engaging units via a sensor on at least one of the plurality of ground engaging units, wherein each of a plurality of vertically movable legs connects one of the plurality of ground engaging units to the frame; and calculating via the controller, a machine speed based on a signal received from the sensor on at least one of the plurality of ground engaging units.

12. The method of claim 11, further comprising:

detecting a vertical movement via a vertical motion sensor attached to the machine; and adjusting the at least one milling parameter to maintain the grade and slope, via the grade and slope system, in response to a signal from the at least one vertical motion sensor that suggests vertical movement of at least one of the plurality of vertically movable legs.

13. The method of claim 12, further comprising:

sending a signal that an obstacle is detected around an exterior of the machine via the controller, to the human-machine interface;

displaying an alert on the human-machine interface that an obstacle is detected around an exterior of the machine; and displaying the obstacle-detection response on the human-machine interface to alert the operator to the response that the machine is going to take to navigate past the obstacle.

14. The method of claim 13, further comprising:

receiving, via the controller, signals from the at least one obstacle-detection sensor, the sensor on at least one of the plurality of ground engaging units, and the vertical motion sensor;

analyzing the received signals to determine if a detected obstacle will contact the milling rotor; and outputting, via the controller, in response to an obstacle that will contact the milling rotor, a jump obstacle-detection response, wherein the jump obstacle-detection response comprises:

overriding the grade and slope system; and raising the milling rotor to avoid contact with the obstacle.

15. The method of claim 13, further comprising:

receiving, via the controller, signals from the sensor on at least one of the plurality of ground engaging units, and a signal from a vertical motion sensor;

analyzing the received signals to determine if a detected obstacle will contact either of the pair of side plates;

outputting, via the controller, in response to an obstacle that will contact either of the pair of side plates, a change sensor obstacle-detection response;

communicating with the grade and slope system, via the controller, to start receiving signals from a slope sensor installed on an inboard ski connected to the milling rotor; and raising at least one of the pair of side plates with an actuator in response to the change sensor obstacle-detection response from the controller to prevent an obstacle from contacting either of the pair of side plates.

16. The method of claim 13, further comprising:

receiving, via the controller, signals from the at least one obstacle-detection sensor, the sensor on at least one of the plurality of ground engaging units, and the at least one vertical motion sensor;

analyzing the received signals to determine if a dip is detected around an exterior of the machine; and outputting, via the controller, in response to the dip around an exterior of the machine, a hold obstacle-detection response, wherein the hold obstacle-detection response comprises:

overriding the grade and slope system; and maintaining at least one of the milling parameters at their present settings.

17. A machine for roadwork, the machine comprising:

a frame;

a power source;

a milling rotor operatively connected to the power source and the frame;

a pair of side plates, the milling rotor is located between the pair of side plates, and at least one of the side plates includes a sensor configured to measure cutting depth of the machine;

an inboard ski connected to the milling rotor, the inboard ski including at least one sensor configured to detect the cutting depth of the machine;

a grade and slope system that can be turned on by an operator of the machine, the grade and slope system includes a slope controller that automatically adjusts at least one milling parameter to maintain a grade and a slope entered by the operator;

an obstacle detector which detects obstacles around an exterior of the machine; and an obstacle detection trigger which activates an obstacle-detection response upon determining that an obstacle will contact either of the side plates, the obstacle-detection response:

raises one or both of the side plates above the milling rotor; and directs the grade and slope system to use the at least one sensor on the inboard ski to measure the grade or slope of the machine.

18. The machine of claim 17, wherein the obstacle detector is configured to detect objects that could contact the milling rotor or a dip or a hole around an exterior of the machine that could cause damage to the machine or cause damage to a roadway that the machine is working on.

* * * * *